US005757730A

United States Patent [19]

Terzian

[11] Patent Number: 5,757,730

[45] Date of Patent: May 26, 1998

[54] LAST MINUTE GRAPHICS FOR BALANCED DIGITAL TIME DISPLAYS

[75] Inventor: Berj Terzian, Croton-on-Hudon, N.Y.

[73] Assignee: Equitime, Inc., Croton-on-Hudson, N.Y.

[21] Appl. No.: 772,013

[22] Filed: Dec. 19, 1996

[51] Int. Cl.[6] ..... G04C 19/00

[52] U.S. Cl. ..... 368/82; 368/239

[58] Field of Search ..... 368/82–84, 239–242

[56] References Cited

U.S. PATENT DOCUMENTS

| | | | |
|---|---|---|---|
| 4,264,966 | 4/1981 | Terzian | 368/82 |
| 4,270,196 | 5/1981 | Terzian | 368/82 |
| 4,271,497 | 6/1981 | Terzian | 368/82 |
| 4,483,628 | 11/1984 | Terzian | 368/82 |
| 4,627,737 | 12/1986 | Nance et al. | 368/239 |
| 4,671,673 | 6/1987 | Terzian | 368/82 |

*Primary Examiner*—Bernard Roskoski
*Attorney, Agent, or Firm*—Lucas & Just

[57] ABSTRACT

To graphically portray the diminution of the last minute before commencement of a next hour in a balanced digital time display, six horizontal elements of a pair of 7-segment arrays of display elements are activated immediately after one remaining minute and zero seconds. These six elements are each individually flashed for and extinguished after ten second intervals, in a sequence that begins with the top element of the outermost array, spaced farthest to the left from the next hour digit, and progresses to the middle and bottom elements of that array, followed by the top, middle and bottom elements of an intermediate array, located between the outermost array and the next hour digit. This sequence provides descending flashing elements in three ladder-like steps down each array, the outermost array graphically portraying the diminution of the first thirty seconds and the intermediate array the diminution of the second thirty seconds of the last remaining minute.

10 Claims, 2 Drawing Sheets

LAST MINUTE GRAPHICS FOR BALANCED DIGITAL TIME DISPLAYS

BACKGROUND OF THE INVENTION

1. Field of the Invention

This invention relates to digital time displays which are useful for general timekeeping. "General timekeeping", as used herein, means the usual timekeeping needs and practices of ordinary individuals occupied with their customary day-to-day activities, as contrasted from special time monitoring procedures such as stop time, split time, lap time and countdown sequences used in games, sporting events, scientific experiments, etc.

2. Description of the Prior Art

Balanced digital time displays useful for general timekeeping are disclosed in U.S. Pat. Nos. 4,264,966; 4,483,628 and 4,627,737, the disclosures of which are incorporated herein by reference. These patents show a central hours display, flanked on the right by elapsed minutes past the current hour and on the left by remaining minutes until the next hour, together with an optional display, below the hour, of seconds counting up and down during each minute, or up during elapsed minutes and down during remaining minutes.

3. Discovery of Problems in the Prior Art

U.S. Pat. No. 4,671,673 discloses a method of graphically indicating the diminution of the last remaining minute before the commencement of a next hour of a balanced digital time display. This method comprises activating, just after one remaining minute and zero seconds, all six horizontal segments of the pair of 7-segment digital display elements otherwise employed to display remaining tens and unit minute values before the next hour. Such horizontal elements are thereafter sequentially flashed and extinguished in synchronism with the remaining fifty nine seconds prior to the onset of the new hour.

The previously disclosed flash/extinguish sequence begins flashing the top segment of the left most array for ten seconds until fifty remaining seconds are reached, then extinguishes such flashing and simultaneously commences the flashing of the top segment of the intermediate array, located between the left most array of horizontal elements and the next hour display, for the next ten seconds until forty remaining seconds are reached. Next, such flashing is extinguished and simultaneous flashing of the middle horizontal segment of the left most array is commenced for the next ten seconds, and so on.

Thus, in the previously disclosed sequence, the flashing horizontal elements alternately switch, in ten second intervals, from the left or outermost 7-segment array to the intermediate 7-segment array of display elements, then back to the outermost array to repeat this cycle twice again to provide indicators, in ten second intervals, of the total remaining time during the last minute before the onset of the next hour.

There are several heretofore unappreciated and undesirable drawbacks of the previously disclosed sequence. First, the flashing elements follow a zigzag path of activation that alternates between (and down) the six horizontal elements of the outermost and intermediate 7-segment arrays. In the complete sequence, there are two returns of the flashing elements from the intermediate to the outermost arrays before the last remaining horizontal element, at the bottom of the intermediate array and immediately adjacent to the displayed next hour, begins flashing to indicate the last remaining ten seconds.

These returns or switchbacks from the intermediate to outermost arrays are undesirable for a number of reasons. First, they shift the flashing element positions from immediately adjacent to the displayed next hour in reverse direction to the more distant position of the outermost array. However, such back shifts visually contradict the fact that the time is continually progressing toward, not away, from the next hour. Secondly, the flashing elements switch forward three times toward the next hour, between identical levels of horizontal elements, which movements are visually inconsistent with the fact that there is no corresponding pause in the continuing decrease in the values of seconds during the last remaining minute before the next hour.

Such contradictions and pauses have now been discovered to give a graphically erratic and confusing sense of time moving toward the next hour and thus detract from the attraction and comprehensibility of the prior art display.

SUMMARY OF THE INVENTION

The present invention avoids the foregoing problems by providing a new display and method which eliminates the alternating zigzag paths of the flashing horizontal segments and the undesirable impressions of pauses in the falling values of seconds caused by successive flashing of horizontal segments at the same level, as encountered in the teaching of U.S. Pat. No. 4,671,673.

In the new display and method of the present invention, the horizontal segments of the outermost 7-segment array are first successively flashed and extinguished in a sequence that begins with the top element, then progresses to the middle element and finally to the bottom element of that array, during the initial remaining thirty seconds. Next, the same sequence is carried out with the three-horizontal elements of the intermediate 7-segment array during the remaining thirty seconds of the last minute before the next hour.

Thus, in the display and method of this invention, the three horizontal elements of the outermost array of display elements, positioned farthest away to the left of the displayed next hour, are flashed and extinguished in three successive steps of progressively dropping levels, which is completely consistent with the fact that the time is likewise continually diminishing in value. Moreover, this stepwise descent of flashing outermost horizontal elements, reminiscent of moving down a ladder, graphically signals that all of the decrease in the so portrayed time is occurring during the initial thirty seconds of the last remaining minute before the next hour.

Thereafter, when the same stepwise descending sequence is repeated with the horizontal elements of the intermediate array of digital display elements, the viewer is thereby graphically signaled that the second thirty seconds of the last minute are ongoing and approaching their ultimate end point as the flashing elements move down the ladder-like array in ten second intervals.

Thus, as a further advantage of the new sequence of the present invention, the bottom horizontal elements of both 7-segment arrays enter into a flashing condition half a minute apart from each other, rather than successively as in U.S. Pat. No. 4,671,673. That interval and relationship renders the bottom flashing elements much more meaningful inasmuch as they inform the viewer, just from their positions, of the near completion of the initial thirty seconds or first half, and thereafter of the last thirty seconds or second half, of the final remaining minute before the next hour. As a result, the sequence of this invention graphically demarcates the last remaining minute in a new and unmistakable manner as consisting of two distinct halves or parts, since all of the flashing descending horizontal elements during the first half are seen exclusively in the outermost ladder-like array, positioned farthest away from the displayed next hour, and thereafter the remaining flashing horizontal elements are similarly seen only in the intermediate ladder-like array located nearest to the displayed next hour. Such symmetry of position and movement, combined with avoidance of all inconsistent back shifts of the flashing elements, renders the last minute graphics of this invention far more superior and effective than the previously-described display.

BRIEF DESCRIPTION OF THE DRAWINGS

Referring now to FIG. 1, the pair of 7-segment arrays of digital display elements positioned to the left of the centrally positioned display of next hour display, ten, have been activated to show a half sized upwardly located zero digit (10), at the outermost array, and a full sized digit one (12), at the intermediate array, thus indicating one minute before 10 o'clock. The advantages of using half-sized zero digits such as (10) to display non-significant tens of minutes values are the subject of co-pending application Ser. No. 08/653,604. The zero digit (14) below the hour display confirms that the exact time is one minute and zero seconds until the next hour. Also, below the one minute display is an optional downwardly pointing hockey stick-shaped underscore line (16) to graphically signal that time is decreasing toward the oncoming next hour.

Figure 1:
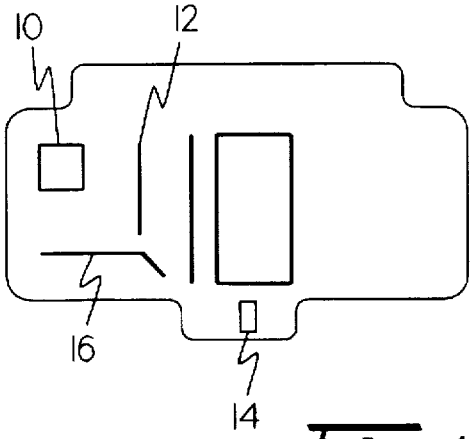
FIG. 1 is a view of digital display elements arranged in the same pair of 7-segment arrays and positions disclosed in U.S. Pat. No. 4,671,673 and activated in this figure to display exactly one minute and zero seconds remaining before 10 o'clock, a next hour.
Figure 2:
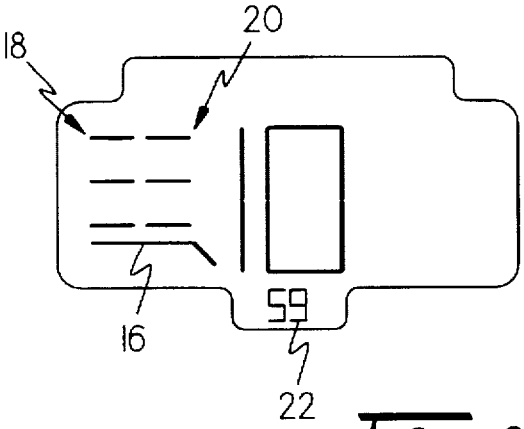
FIG. 2 shows the display activated at exactly one second after the time depicted in FIG. 1.

Referring next to FIG. 2, this shows the display activated at exactly fifty-nine seconds before the next hour, which is one second after the time displayed in FIG. 1. All six horizontal display elements of both the outermost (18) and intermediate (20) pair of 7-segment arrays have been activated to show adjacent 3-step ladder-like appearances above the hockey stick underscore line (16), and the pair of 7-segment display elements (22) below the next hour have been activated to show the value of fifty-nine seconds.

Figure 3:
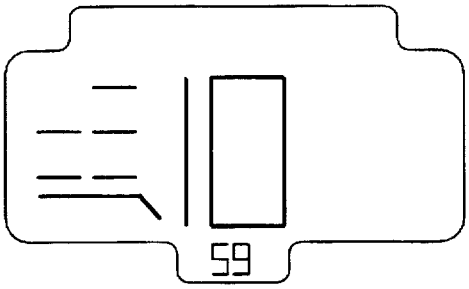
FIG. 3 shows the display activated at exactly one-half second after the time depicted in FIG. 2.

FIG. 3 shows the display exactly one-half second after the time displayed in FIG. 2. The top segment of the outermost array (18) has been extinguished to flash that specific element, while fifty-nine seconds continues to be displayed below the next hour. Thus, the sequence of FIG. 2 followed by FIG. 3 shows how the display will appear as the top segment is flashed ten times in synchronism with the values of seconds decreasing ten times from fifty-nine to fifty, with inclusion of the optional hockey stick underscore line (16).

It should be noted that the remaining two middle and bottom elements of the outermost (18), and all three elements of the intermediate (20), 7-segment arrays remain steady on during the entire ten-second interval of fifty-nine to fifty remaining seconds, thus graphically indicating that the countdown of time is progressing toward fifty remaining seconds which will end this period.

Figure 4:
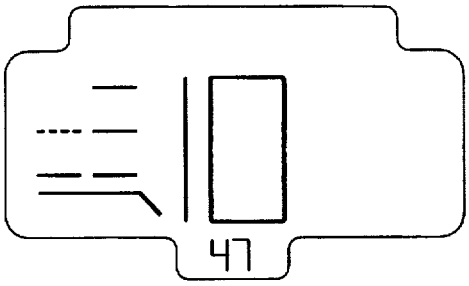
FIG. 4 shows the display activated at exactly forty-seven seconds before the next hour, with the flashing element shown in dots rather than a line for reasons of clarity, as explained below.

FIG. 4 shows the display activated at exactly forty-seven remaining seconds before the next hour. This is graphically indicated by flashing of the middle element of the outermost array (18), which is dotted to contrast its flashing condition from the remaining four steadily seen elements comprising the bottom element of the outermost array (18) and all three elements of the intermediate array (20). Thus, the representative display of FIG. 4 is maintained during the ten-second period from forty-nine to forty remaining seconds, with the graphic reminder from the four steady elements that the countdown is proceeding toward the forty second value marking the end of this next ten-second period.

Figure 5:
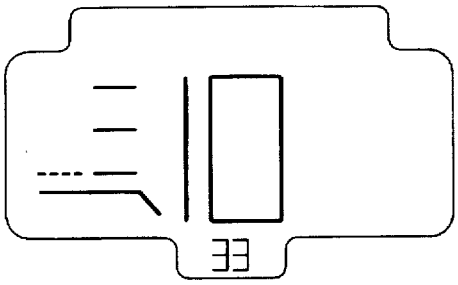
FIG. 5 shows the display activated at exactly thirty-three seconds before the next bar, again with flashing element in dots.

FIG. 5 shows the display activated at exactly thirty-three seconds before the next hour. Here the bottom (dotted) element of the outermost array (18) is the one that is flashed as seconds are counted down from thirty-nine to thirty below the next hour. The disappearance of the previously flashed middle and top elements of the outermost array (18) and the intact ladder-like array of the adjacent three intermediate elements (20) serve as an easily remembered picture which signifies that half of the remaining minute is approaching its end point of thirty seconds during this period.

Figure 6:
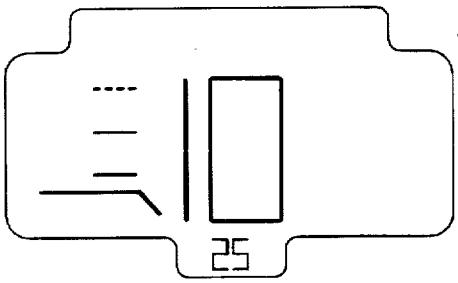
FIG. 6 shows the display activated at exactly twenty-five seconds before the next hour, with the dotted flashing element.

FIG. 6 shows flashing of the top (dotted) element of the intermediate array (20) as a representative display during the period of twenty-nine to twenty seconds, the value of twenty-five marking the half way point during this interval. Here the fact that flashing of the top element of the second ladder-like array (20) has commenced is alone significant as a graphic indicator that the second half of the last remaining minute is under way toward its ultimate end point of coinciding with the next hour's onset.

Figure 7:
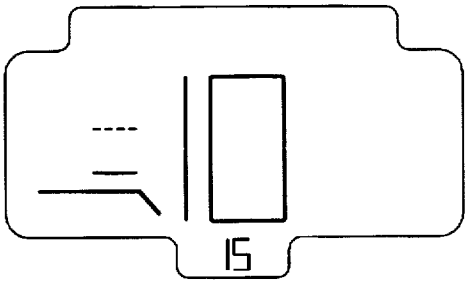
FIG. 7 shows the display activated at exactly fifteen seconds before the next hour, including the dotted flashing element.
Figure 8:
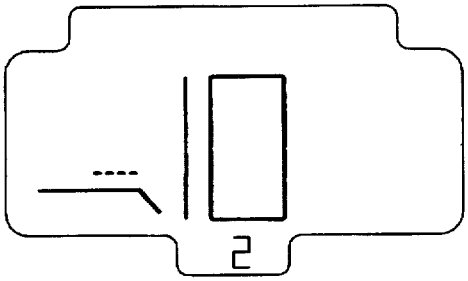
FIG. 8 shows the display activated at exactly two seconds before the next hour with a single dotted flashing element.

FIGS. 7 and 8 complete the appearance of representative displays seen during the final two ten-second intervals before the onset of the next hour. FIG. 7 shows the flashing middle segment of the intermediate array (20) above the steady on single remaining bottom element of that array, to indicate that the remaining time in seconds is in the teens and approaching value ten as the end point of this penultimate ten-second period. FIG. 8 shows the flashing of the same remaining single bottom element to indicate that unit seconds are being counted down toward value zero which will coincident with the commencement of the displayed next hour, ten o'clock.

The invention has been described above in terms of its general principles and a specific embodiment. Many variations of such disclosure will be obvious to those skilled in the art. For example, the hockey stick underscore line 16 can be eliminated as superfluous in view of the superior graphics provided by operation of the ladder-like arrays (16) and (18) in accordance with the invention. Alternatively, both the underscore line and some or all of the values of seconds below the hour display can be deleted for similar reasons.

Also, with dot matrix displays, the flashing elements can be replaced with racing dots successively activated to move toward the next hour during each second of each ten second countdown interval, either by staying on to form a dotted line during each such second or by activating on and off in consecutive manner to display a moving dot tracing a linear horizontal path from left to right during each second.

It will be understood that the claims are intended to cover all changes and modifications of the preferred embodiments of the invention herein chosen for the purpose of illustration which do not constitute a departure from the spirit and scope of the invention.

I claim:

1. In a balanced digital display system which shows remaining minute digits on the left side of a next hour digit, an improved display of graphics during the last remaining minute which comprises a display of six horizontal elements arranged in two ladder-like arrays of three elements each, one array being located in an outermost position spaced farthest to the left from the next hour digit, and the other array being located in an intermediate position, between the one array and the next hour digit, said elements each being individually flashed for and extinguished after a ten-second interval and in a successive sequence which begins with the top element of the outermost array and progresses to the middle and bottom elements of that array and then to the top, middle and bottom elements of the intermediate array, whereby diminution of the last remaining minute is graphically portrayed in ten-second intervals by such sequentially flashed and extinguished elements.

2. The improved display in accordance with claim 1 which further includes a hockey stick-shaped display element positioned below the outermost and intermediate arrays, with the blade segment thereof oriented to point downwardly toward the next hour digit.

3. The improved display in accordance with claims 1 or 2 which further includes a display of seconds digits below the next hour digits showing a count down of seconds.

4. An improved display in accordance with claim 3 in which the seconds digits count down from 59 to zero during the entire period of the last remaining minute.

5. The improved display in accordance with claims 1 or 2 in which the six horizontal elements correspond to and are located in substantially the same positions as the horizontal elements of a pair of 7-segment display elements used to display remaining minutes before the next hour prior to the last remaining minute.

6. A method for graphically portraying the last remaining minute in a balanced digital time display wherein remaining minute digits are displayed on the left side of the next hour, said method comprising the steps of:

activating six horizontal display elements arranged in two ladder-like arrays of three elements each, one array being located in an outermost position spaced farthest to the left from the next hour digit and the other array being positioned in an intermediate position between the outermost array and the next hour digit; and flashing each said element for ten seconds and thereafter extinguishing it, in a successive sequence which begins with the top element of the outermost array and progresses to the middle and bottom elements of that array and then to the top, middle and bottom elements of the intermediate array, whereby diminution of the last remaining minute is graphically portrayed in ten-second intervals by such successively flashed and extinguished elements.

7. The improved method in accordance with claim 6 which further includes displaying a hockey stick-shaped element below the outermost and intermediate arrays, with the blade segment thereof oriented to point down toward the next hour digit.

8. The improved method in accordance with claims 6 or 7 which further includes showing seconds digits counting down seconds below the next hour digit.

9. The improved method in accordance with claims 6 or 7 which further includes showing a countdown of seconds from 59 to zero during the entire period of the last remaining minute.

10. The method in accordance with claims 6 or 7 which further includes the steps of activating the same elements of the outermost and intermediate arrays to display remaining minutes before the next hour prior to the last remaining minute.

* * * * *